United States Patent [19]

Hall

[11] 4,159,077

[45] Jun. 26, 1979

[54] PROCESS FOR CLOSING A FLEXIBLE CONTAINER AND THE CONTAINER FORMED THEREBY

[75] Inventor: Stanley D. Hall, Taylors, S.C.

[73] Assignee: W. R. Grace & Co., Duncan, S.C.

[21] Appl. No.: 748,998

[22] Filed: Dec. 9, 1976

[51] Int. Cl.[2] ..... B65B 7/02; B65B 7/12; B65D 33/18

[52] U.S. Cl. ..... 229/62; 53/480; 53/483; 150/3; 156/245; 156/267; 264/271; 264/339

[58] Field of Search ..... 53/14, 37, 38, 39, 41, 53/44, 140, 410, 416, 417, 476, 480, 483; 156/69, 245; 229/62; 264/259, 268, 271, 339; 150/3

[56] References Cited

U.S. PATENT DOCUMENTS

| | | | |
|---|---|---|---|
| 2,663,461 | 12/1953 | Brown | 53/29 X |
| 2,874,418 | 2/1959 | Repici | 53/38 X |
| 3,358,905 | 12/1967 | Soesbergen | 53/14 X |
| 3,620,862 | 11/1971 | Nier | 156/69 |

FOREIGN PATENT DOCUMENTS

| | | | |
|---|---|---|---|
| 1214133 | 4/1966 | Fed. Rep. of Germany | 53/14 |

*Primary Examiner*—Robert Louis Spruill
*Attorney, Agent, or Firm*—John J. Toney; William D. Lee, Jr.; John B. Hardaway

[57] ABSTRACT

The opening of a flexible container is closed by gathering the portion defining the opening into a bunch, surrounding the opening with an adhesive and allowing the adhesive to harden.

9 Claims, 5 Drawing Figures

PROCESS FOR CLOSING A FLEXIBLE CONTAINER AND THE CONTAINER FORMED THEREBY

BACKGROUND OF THE INVENTION

This invention relates to a process for closing flexible containers and to the closure produced by such a process. It particularly relates to a closure which not only maintains the contents of a container within the container but also prevents the ingress of deleterious atmosphere into the container.

It is known in the art, to close flexible containers with different types of complicated assemblies in which various parts are required. U.S. Pat. No. 3,308,936 to Roland features the use of a metallic cap disposed over the opening of a flexible container with a sealant adhering the metallic cap to the container itself. U.S. Pat. No. 3,317,119 to Lasoff discloses a plastic retaining ring which encircles the twisted neck of a flexible container. U.S. Pat. No. 3,197,938 shows a similar construction for a flexible container closure. Another approach to the problem is disclosed in U.S. Pat. No. 3,111,794 to Spolsino. This patent discloses a process for sealing a flexible container composed of a thermoplastic material by first clipping the opening of the flexible container and subsequently heating the gathered portion near the clip to melt and adhere the gathered material to itself.

While all of the above mentioned processes and closures are satisfactory for most applications, room exists for improving the aesthetics, reliability and production efficiency of such processes and closures. The realibility of closures for flexible containers is particularly critical when the container is designed for protecting food articles such as fresh meat from the deleterious effects of the surrounding environment. In such instances the closure for the flexible container must be efficacious not only from the standpoint of closing the container but also from the standpoint of preventing ingress of deleterious atmosphere into the closed container. In instances where the food article is intended for a subsequent freezing step, the container closure must be able to retain its reliability after being subjected to a freezing and thawing environment.

SUMMARY OF THE INVENTION

It is thus an object of this invention to provide a novel closure for flexible containers.

It is a further object of this invention to provide a closure for flexible containers which is effective to prevent the ingress of deleterious atmosphere into the closed container.

It is a still further object of this invention to provide such a closure which possesses the requisite reliability for use in packaging food article.

It is a yet further object of this invention to provide a closure for flexible containers which is not only reliable but which maintains its reliability after being subjected to adverse conditions.

It is a yet further object of this invention to provide a process for producing the closure in accordance with this invention.

These as well as other objects are accomplished by surrounding the opening of a flexible container with a flowable adhesive and hardening the adhesive into hermetic sealing engagement with the container opening.

DETAILED DESCRIPTION

In accordance with this invention it has been found that a bag closure which comprises a hardened adhesive surrounding an opening of a flexible container possesses superior attributes with regard to aesthetics, reliability and ease of production. It has been found that such a closure may be quickly and efficiently produced by surrounding an opening of a flexible container with flowable adhesives and by hardening the adhesive into a hermetic sealing engagement with the container opening.

The closure and process of producing a closure in accordance with this invention may be more readily understood from the following particularized description with reference to the various figures of drawings.

Figure 1:
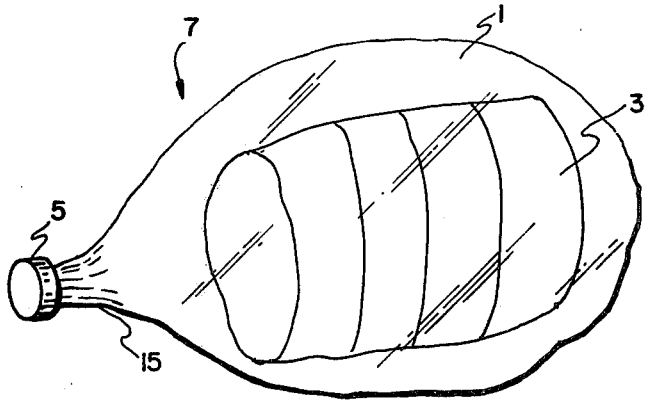
FIG. 1 illustrates a container closed utilizing the closure of this invention.

Referring to FIG. 1 of the drawing, a container 1 having an article 3 contained therein as closed by means of closure 5. The closure 5 in accordance with this invention surrounds the entire opening of the container 1. The closure 5 is such that the edges of the container opening are totally surrounded on the exterior of a container by the hardened adhesive. The adhesive, as will be further discussed below, adheres to the flexible material of which the flexible container is composed to provide mechanical strength and reliability to the overall package 7. The closure 5 is thus a unified hardened mass which both adheres to and surrounds the exterior of the opening of a flexible container. It is not necessary for the hardened mass to actually enter the opening of the container to provide desirable properties. No deleterious results, however, are achieved if a portion of the unified hardened mass does actually enter the opening of the container. The closure of this invention may be better understood from the following description of the process by which it is produced.

Figure 2:
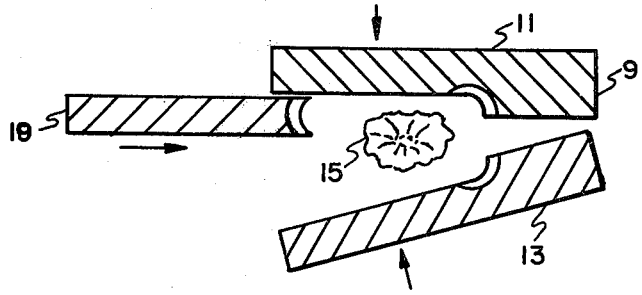
FIGS. 2 through 5 schematically illustrate various steps carried out in the preferred process of this invention.
Figure 4:
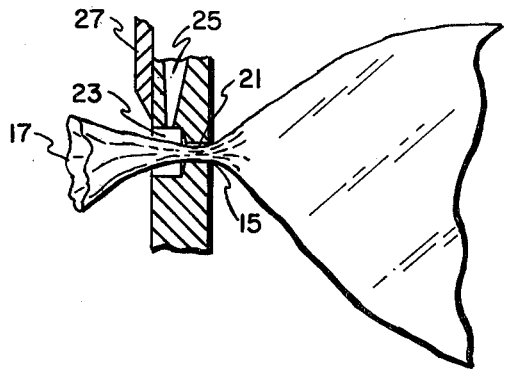
Figure 5:
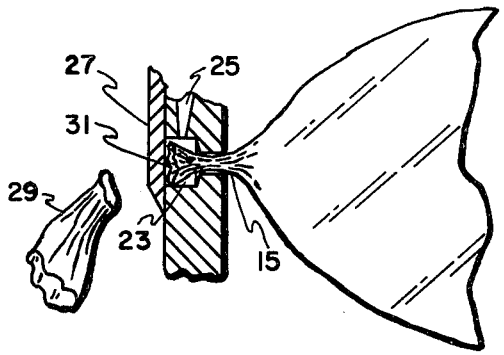

The process of this invention is carried out by simply contacting the exterior of the opening of a flexible container with a flowable adhesive and by hardening the adhesive into hermetic sealing engagement with the container opening. The container opening need not necessarily be gathered or bunched together prior to contacting with the adhesive. It is preferred, however, to gather the opening so as to provide a neater as well as a stronger closure upon the hardening of the adhesive material. FIG. 2 of the drawings illustrates a die apparatus which is preferably utilized in forming the closure of this invention. Clamp 9 having halves 11 and 13 is utilized to gather the neck 15 of a container which leads to opening 17. This aspect of the process of this invention is best seen in FIG. 4. Referring again to FIG. 2 of the drawings the clamp halves 11 and 13 are closed in the direction indicated by the arrows to gather the neck of the container. Insert 19 completes the step of gathering such that the neck 15 of container 1 is bunched together in opening 21 which results from the mating together of parts 11, 13 and 19. The gathering step is preferably carried out to the extent that the neck of the flexible container is in such contiguous relationship with itself that the contents of the container are hermetically isolated from the exterior atmosphere by the mere gathering step. The term gathering is used broadly herein to include other bundling techniques such as gathering by twisting.

Figure 3:
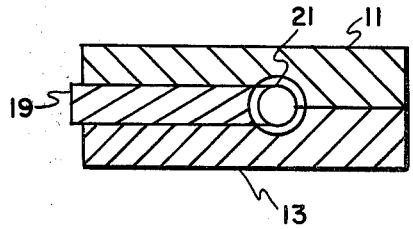

Referring to FIG. 3 of the drawings, upon mating of parts 11, 13 and 19 the bag neck 15 is effectively gathered within opening 21. Referring to FIG. 4 of the drawings it is seen that above opening 21 is a larger opening or cavity 23 which is in communication with sprue 25. Shown in FIG. 4 adjacent cavity 23 is cut off blade 27. Blade 27 is in sliding and cutting relationship to parts 11, 13, and 19 such that the excess bag material above the plane of parts 19, 11 and 13 may be severed by sliding blade 27 across cavity 23. It is understood, however, that the step of cutting is not necessary to the process of this invention. The step of cutting, however, provides flexibility to the overall process such that containers of a single size may be utilized for packaging articles of varying size. By severing excess container, the articles of varying size, e.g., fresh meat article, after the step of severing, are contained within a flexible container appropriately sized for such articles. Uniformly sized articles can, of course, be closed by the process of this invention without the step of severing excess container. The step of severing may, however, be eliminated when packaging articles of nonuniform size if the fit of container to article is not an important aspect of the resulting package.

The selvage 29 produced by the step of severing is removed from the process environment after such step. The movement of blade 27 over cavity 23 produces a generally enclosed cavity which communicates with sprue 25. The new bag opening 31, produced by the step of severing, splays after the severing step such that the opening 31 is no longer in contact with blade 27. There is, thus, a gap totally surrounding the bag opening 31 such that the introduction of a flowable adhesive through sprue 25 totally surrounds the opening 31 to produce the closure 5 upon hardening. Cavity 23 is illustrated here with no means for venting. It is understood, however, that an additional port communicating with cavity 23 may be provided to vent the cavity during the introduction of the flowable adhesive. In actual operation the opening 21 surrounding the bag neck 15 has sufficient residual space to provide for adequate venting during the step of introducing the flowable adhesive. During the step of introducing the adhesive, it is preferred that the pressure of mating pieces 11, 13 and 19 be maintained so as to hold the container neck 15 in a hermetically sealed position such that the hardening of the flowable adhesive maintains the hermetic gathered relationship of the bag neck. This pressure is preferably maintained during the time period in which the adhesive hardens to prevent the container from popping open. No particular pressure, however, needs to be maintained within cavity 23 during the step of hardening. The cavity 23 merely serves the purpose of containing the adhesive while in its flowable condition rather than molding the adhesive. The cavity 23, however, may serve the purpose of molding the closure 5 into an attractive configuration while simultaneously serving the primary function of containing the adhesive during the hardening process.

The above description of the process of producing a closure in accordance with this invention has emphasized the preferred embodiment thereof. It is understood that the process embodies closing more than one opening in a single container as well as closing an opening without gathering the opening prior to contacting with an adhesive. In the latter instance there is no requirement for a mold to be maintained around the container opening during either the contacting or hardening steps. It is only required that the container configuration contacted by the flowable adhesive be maintained during the hardening of the adhesive so as to prevent the opening from popping open prior to the hardening of the adhesive.

The adhesive utilized in the process of this invention to produce the bag closure of this invention may be any conventional well known hardenable adhesive. The only requirement of the adhesive is that it adhere to the composition of the flexible container and that it be flowable and hardenable. The adhesive is preferably of an organic origin rather than an inorganic. Inorganic adhesives, however, are not excluded from the scope of this invention. Among the organic adhesives both natural and synthetic adhesives may be utilized. Such synthetic adhesives embody elastomer-solvent cement, polysulfide sealants, thermoplastic resins, thermosetting resins, and silicone polymers and cement. Amongst the thermosetting resins useful in this invention are the epoxy, phenoformaldehyde, polyvinyl butyral and cyanoacrylates. The terms polymer, polymeric, and poly(prefix) includes polymers, ionomers, copolymers, interpolymers, homopolymers, and block or graft polymers.

The preferred adhesive for use in this invention is a synthetic thermoplastic resin. Such resins are commonly referred to as hot melt adhesives. Such hot melt adhesives include polymers of ethylene, butylene, amides and vinyl acetate. Particularly effective thermoplastics include unsaturated ester polymers such as ethylene/unsaturated ester copolymers, e.g., ethylene/-vinyl acetate, ethylene/vinyl propionate, ehtylene/-methyl methacrylate, ethylene/ethyl methacrylate, ethylene/acrylate, ethylene/isobutyl acrylate, and the like; unsaturated carboxylic acid polymers, e.g., ethylene/unsaturated carboxylic acid copolymers e.g., ethylene/acrylic acid, ethylene/methacrylic acid, ethylene/maleic acid, ethylene/fumaric acid, ethylene/itaconic acid, and the like; low molecular weight polyethylene, low molecular weight polypropylene and low molecular weight polyolefins. An especially preferred unsaturated polymer is an ethylene/vinyl acetate copolymer having from about 15 to about 40 weight percent of vinyl acetate. Also preferred are the polymers of olefin/unsaturated carboxylic acids containing from about 3 to about 30 weight percent of alpha, beta-ethylenically unsaturated acid for example, ethylene/acrylic acid copolymers having from about 3 to about 12 weight percent of acrylic acid.

The conventionally utilized hot melt adhesives are also useful for producing the container closure of this invention. Hot melt adhesives for purposes of this disclosure are thermoplastic materials which have a very narrow melting range. Most hot melt adhesives melt within the temperature range of 200° to 300° F. A discussion of hot melt adhesives appears on page 519 of Modern Packaging Encyclopedia, a 1971 Issue, which is herewith incorporated by reference.

A particularly preferred class of adhesives for use in accordance with this invention are the ionomer adhesive resins. Ionomer resins are copolymers of ethylene and vinyl monomers. The preferred ionomer for use with the process of this invention is a copolymer of ethylene and acrylic acid neutralized with either sodium or zinc. Such ionomer resins melt with the temperature range of 325° to 350° F. When using such ionomer resins, it has been found that an effective closure may be formed in about 4 seconds with cold steel dies substantially the same size as those depicted in the drawings.

Polyamide resins have also been found to be useful for forming the closures of this invention. The polyamide resins melt at a temperature of about 450° F. Such resins are therefore more complex in their handling than the ionomer and hot melt adhesive resins.

It has been found that the adhesives mentioned above are useful for forming closures on substantially all conventional flexible container materials. Such materials comprise amide polymers, copolymers of ethylene and vinyl acetate, polymers of ethylene, polymers of propylene, copolymers of vinylidine chloride and vinyl chloride (commonly known as saran), polystyrene, polyurethane, polyvinyl alcohol, polymers of vinyl chloride and plasticized polymers of vinyl chloride. The above listing of materials which may comprise the flexible container material is illustrative rather than restrictive in its nature. It is readily apparent that virtually any flexible material may be utilized to form a flexible container for closure in accordance with this invention.

It is thus seen that closure of this invention provides a novel solution to the problem of maintaining articles within flexible containers. Not only does the closure and the process of producing the closure in accordance with this invention function to maintain articles within a container, but it also provides protection to the contained articles from the ingress of deleterious substances such as air and fluids used as a freezing medium. The closure of this invention thus is reliable even in adverse environments. It is further seen that the process of producing a closure in accordance with this invention provide a quick and efficient method for reliably and aesthetically closing flexible containers.

A reading of the above description of the preferred embodiments of this invention will bring to mind many variations to those who are skilled in the art. Such variations, however, are embodied within the scope of this invention as is measured by the following appended claims.

What is claimed is:

1. A process for closing a flexible container, said flexible container terminating in a portion defining an opening comprising the steps of:

gathering said portion defining an opening into a bunch;

applying to the end of the gathered bunch a flowable adhesive in the liquid state to surround said opening on the exterior of said container with said flowable adhesive; and hardening said adhesive into hermetic sealing engagement with said opening.

2. The process, according to claim 1, comprising, after said step of gathering, the further step of severing excess container from said bunch to thus provide a new opening for carrying out said steps of applying and hardening.

3. The process, according to claim 1, wherein said flowable adhesive is a thermoplastic resin and said step of hardening comprises the step of cooling said flowable adhesive into a hardened mass.

4. The process, according to claim 3, wherein said thermoplastic resin is an ionomer resin and said step of applying is carried out with said ionomer resin in a liquid state at a temperature within the range of 300° to 350° F.

5. The process, according to claim 3, wherein said thermoplastic resin is an amide polymer and said step of applying is carried out with said amide polymer at a temperature above 400° F.

6. The process, according to claim 3, wherein said adhesive is a hot melt adhesive at a temperature within the range of 200° to 300° F.

7. The process according to claim 1 comprising carrying out said step of gathering by closing a die about said portion defining an opening and carrying out said step of applying by filling the cavity of said die with said flowable adhesive.

8. The process according to claim 7 including the further step of severing excess bag prior to said step of applying and while said portion defining an opening is enclosed within said die.

9. A closed container produced by the process of claim 1.

* * * * *